US006712650B1

(12) United States Patent
Cheng

(10) Patent No.: US 6,712,650 B1
(45) Date of Patent: Mar. 30, 2004

(54) CLAMPING STRUCTURE FOR CONTINUOUS TERMINAL

(75) Inventor: Tien-Chiao Cheng, Taoyuan (TW)

(73) Assignee: Kingfont Precision Ind. Co., LTD (TW)

( * ) Notice: Subject to any disclaimer, the term of this patent is extended or adjusted under 35 U.S.C. 154(b) by 0 days.

(21) Appl. No.: 10/396,555

(22) Filed: Mar. 26, 2003

(51) Int. Cl.[7] ..... H01R 9/24

(52) U.S. Cl. ..... 439/891; 439/885; 439/879; 29/878; 29/879

(58) Field of Search ..... 439/885, 891, 439/879; 29/878, 879

(56) References Cited

U.S. PATENT DOCUMENTS 4,369,572 A * 1/1983 Atkins ..... 29/879
5,675,891 A * 10/1997 Childs et al. ..... 28/879
5,888,107 A * 3/1999 Seymour et al. ..... 439/891
6,290,556 B1 * 9/2001 Howland et al. ..... 439/879
2001/0049877 A1 * 12/2001 Sato et al. ..... 29/860

* cited by examiner

*Primary Examiner*—Tho D. Ta
(74) *Attorney, Agent, or Firm*—Birch, Stewart, Kolasch & Birch, LLP

(57) ABSTRACT

A clamping structure for continuous terminals is easy for assembling and has alignment effect so that not only the cost for processing such as electroplating is reduced but the terminals during automatic assembling process is well protected and aligned. The quality of continuous terminals is improved. The invention features in that: a holding plate with a plurality of strip hole, whose cross-section is reverse U-shaped, formed by pressing is disposed on one end of a plurality of wires. The wires have two stoppers on the position corresponding to two ends of the strip hole so as to fix each wire firmly after the wire is mounted into the strip hole. A projecting point is pressed on each of two inner sides of the strip hole so as to position the wires vertically.

8 Claims, 13 Drawing Sheets

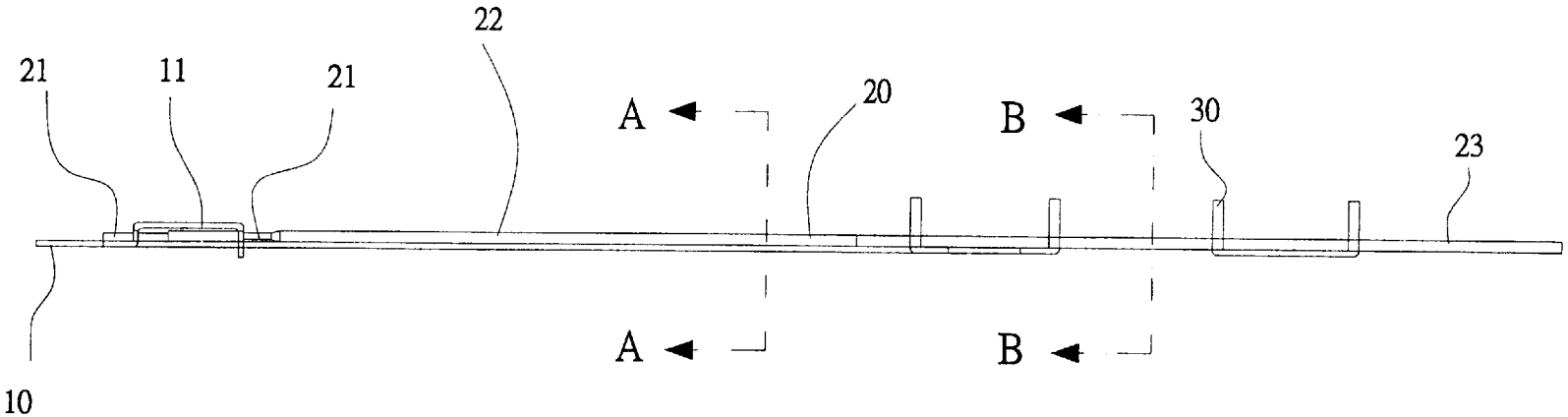
Fig.6
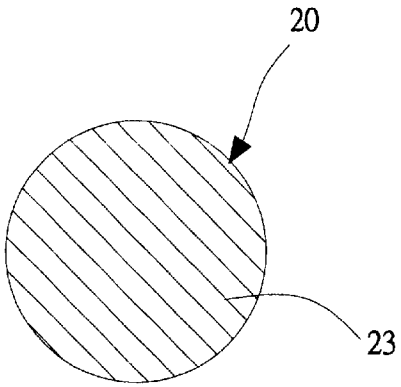
Fig.6B-B
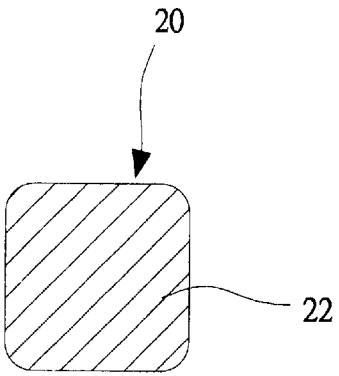
Fig.6A-A

CLAMPING STRUCTURE FOR CONTINUOUS TERMINAL

BACKGROUND OF THE INVENTION

1. Field of the Invention

The present invention relates to a clamping structure of continuous terminals, especially to a clamping structure that is in simple design and is easy for assembling so as to pressed and fixed the continuous terminals on clamping band for the convenience of bending or electroplating process.

2. Description of the Prior Art

The current production of elastic (continuous) terminal in nowadays has to choose adequate raw material first, then casting into several elastic terminals with solidary basement that could be bended and partly galvanized for further processing to attain the finished elastic (continuous) terminals. Although the traditional production procedures used popularly could gain better position effect in the processing procedure of bending and electroplating of terminal, these processing caused material wasting, and could not match cost saving purpose. The finished goods produced by such continuous casting method has following disadvantages: plating material were drawing and extending into longitudinal material which has better longitudinal elasticity; the finished goods produced by continuous casting method could only make used of transversal elasticity.

In the casting processing of continuous casting always caused twist, cricked due to unequal stressing pressure, especially refer to stressing longer and slimmer material (as per FIG. 12). Because the less elasticity and cracking after bending increase the possibility of producing defective connectors, and therefore could not meet the quality requirement in the market.

3. Furthermore, the continuous terminal in the current hubs always use whole wire gilt in a round reel, that is, cutting gold reel into needle-like pieces, and then combined with plastic shell into connector, although the good elasticity of gilt reel meet the market requirement, has following defectives:

3.1 lack of Solderability, flux needs to be added during the soldering process so that the pollution is caused.

3.2 unable to make selective galvanization, and result expensive cost of gilt. The longer and thicker the reel is, the higher cost will get; same as to the palladous reel.

3.3 unable to be automatic combined when cutting the reel into needle-like pieces.

SUMMARY OF THE INVENTION

It is therefore a primary object of the present invention to provide a clamping structure for elastic terminals that is easy assembled and with securely alignment effect.

A further object is to provide a clamping structure for elastic terminals which is used in combination with at least one fixed clamping band and/or moveable clamping band so as to be applied to the alignment of the continuous terminals with general distance between two adjacent terminals or with short distance (high density).

A further object is to provide a clamping structure for elastic terminals which protects and fix the wires (terminals) during the electroplating and assembling process so as to avoid the deformation caused by the long distance between one end of wires and the clamping point. Especially when the distance between two adjacent terminals is too small to be assembled, the plastic housing can be formed by injection and disposed on the proper position of the wires alignment by clamping band.

A further object is to provide a clamping structure for elastic terminals that from one end of the round wires (terminals), extending towards to the other end for a certain distance, the wires are forging into ones with square cross-section that can be electroplated (gold-tin or others). Thus the cost is down and having better conductivity and soldering effect.

A further object is to provide a clamping structure for elastic terminals that is used in combination with a movable clamping band so as to enlarge or shorten the distance between two adjacent wires for two corresponding parts with different hole locations.

A further object is to provide a clamping structure for elastic terminals that the distances between two adjacent openings on the vertical wall of the holding band integrally with the fixing parts is different from that of the two adjacent fixing parts of the holding plate so that the bent wires can be used for changing distance between adjacent wires.

BRIEF DESCRIPTION OF THE DRAWINGS

The accomplishment of the above-mentioned object of the present invention will become apparent from the following description and its accompanying drawings which disclose illustrative an embodiment of the present invention, and are as follows:

FIG. 6 is a cross sectional view of the embodiment in FIG. 5;

FIGS. 6 A—A and 6 B—B are cross sectional views of FIG. 6;

DETAILED DESCRIPTION OF THE PREFERRED

Figure 1:
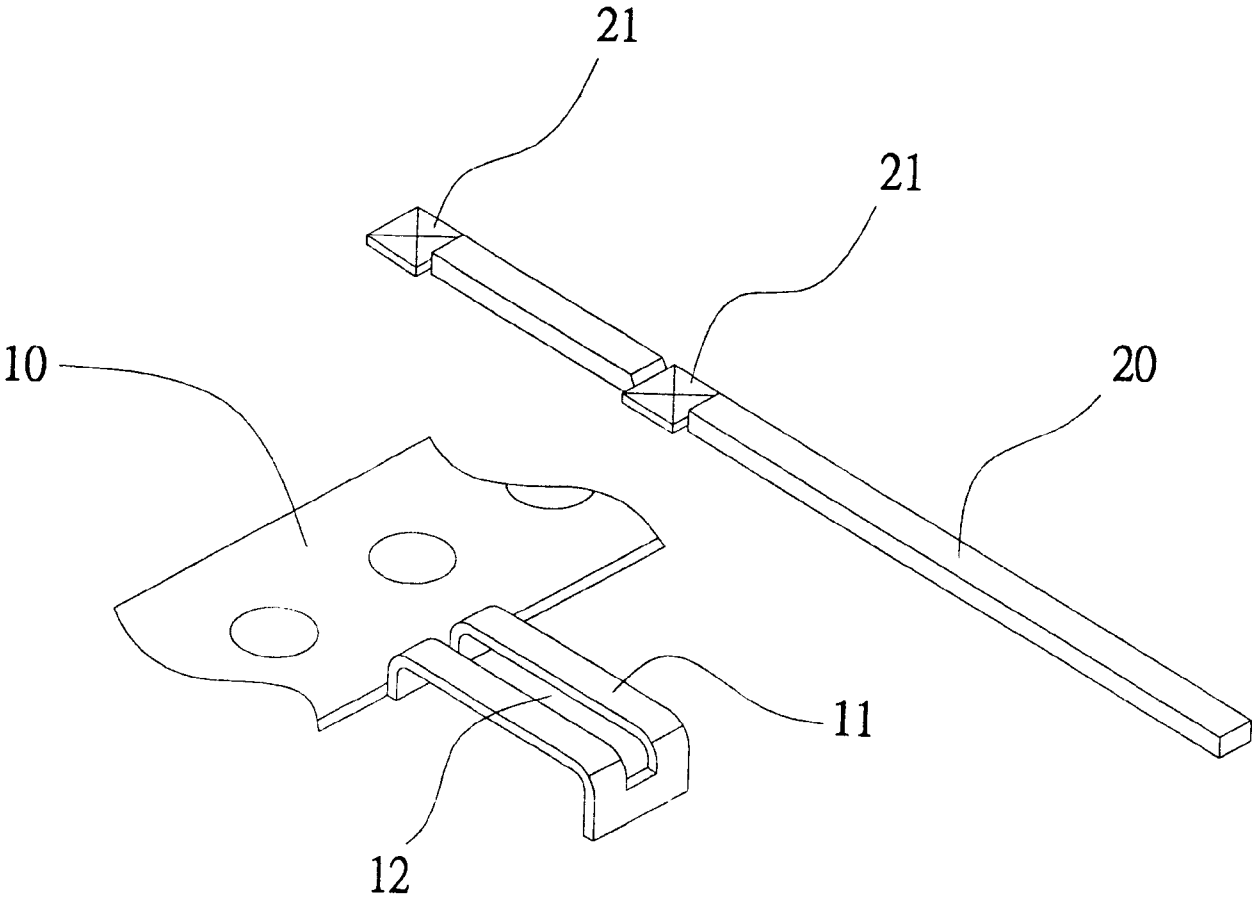
FIG. 1 is an explosive view of an embodiment of the present invention.
Figure 2:
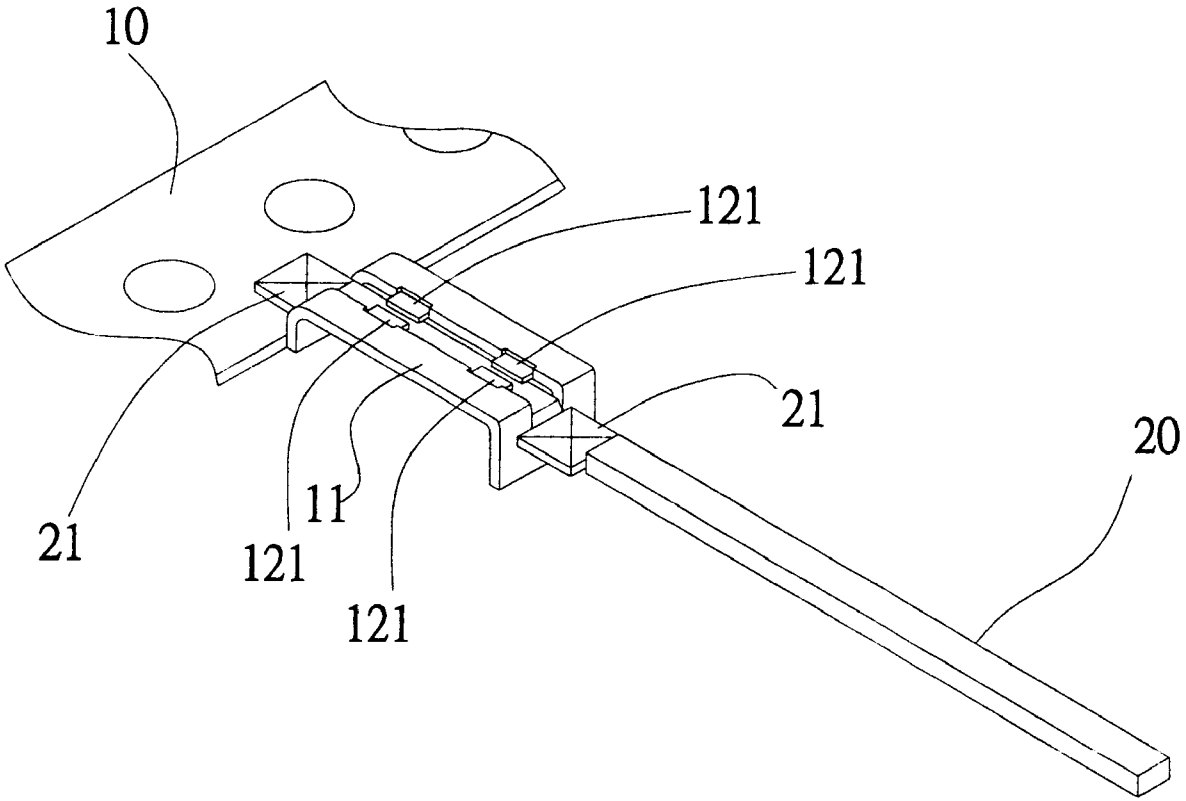
FIG. 2 is an assembling view of the embodiment of the present invention shown in FIG. 1.
Figure 3:
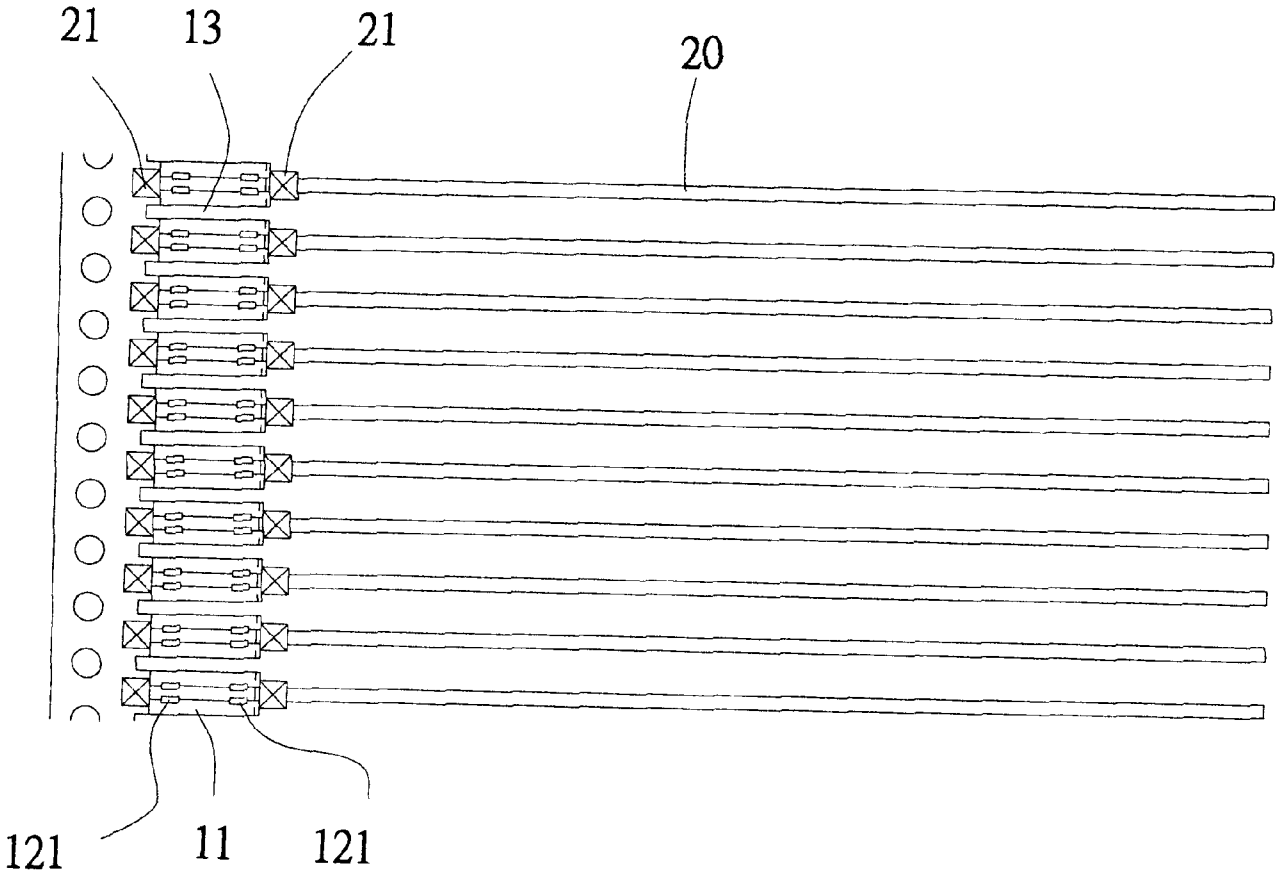
FIG. 3 is a top view of the embodiment of the present invention shown in FIG. 1.

Refer to FIG. 1 & FIG. 3, the present invention includes a holding plate 10 and wires 20. The holding plate 10 is pressed to form a plurality of fixing parts 11 and a strip hole 12 formed by pressing on the middle of each fixing part 11 for accommodation and alignment of wires 20. The side view of the fixing parts 11 is reverse U-shaped. For providing a plurality of wires 20 suitable mounting position, a gap 13 is predetermined between the two adjacent fixing part 11 so that the wires 20 can be fixed properly. A flat pressed stopper 21 is on one end of the wires 20 and the other stopper 21 is arranged on the position of certain distance extends from that end. The distance between the two stopper 21 equals to that of the strip hole 12 on the fixing part 11. When the wires 20 are mounted into the strip holes 12, the wires 20 are horizontally aligned by the two stoppers 21 being placed on two sides of the fixing part 11. Furthermore, a projecting point 121 is pressed on the proper position of each of two inner sides of the strip hole 12 so as to align the wires 20 vertically.

Refer to the embodiments form FIG. 4 to FIG. 7, the holding plate 10 for fixing wires 20 can be pressed to various types and used in combination with at least one fixed clamping band 30 and/ or one moveable clamping band 40. The side view of the fixed clamping band 30 and the moveable clamping band 40 is U-shaped with openings 31, 41 on the position vertically corresponding to the fixing parts 11.

Figure 5:
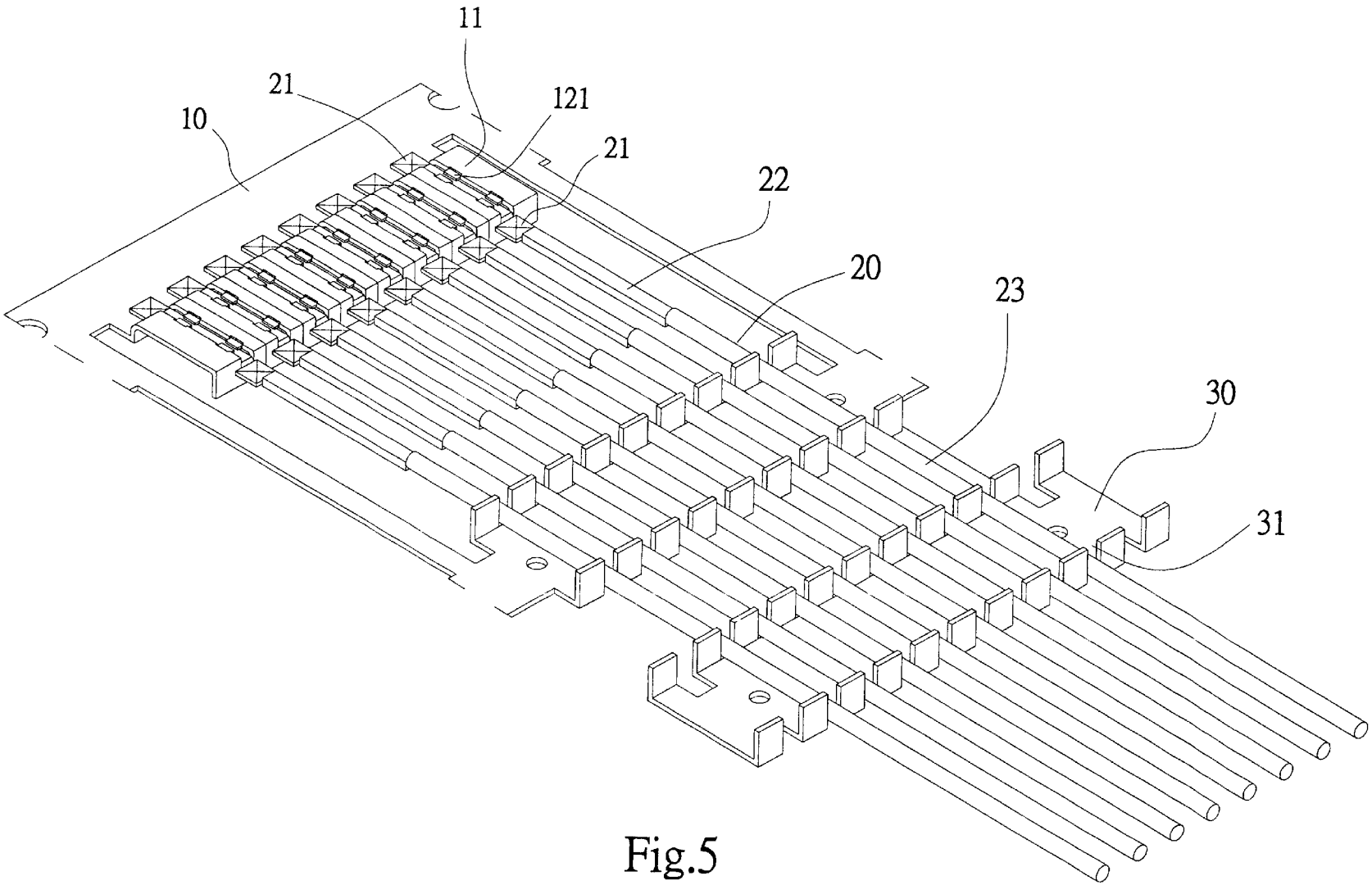
FIG. 5 is a holding plate of an embodiment of the present invention in combination with a fixed clamping band.
Figure 8:
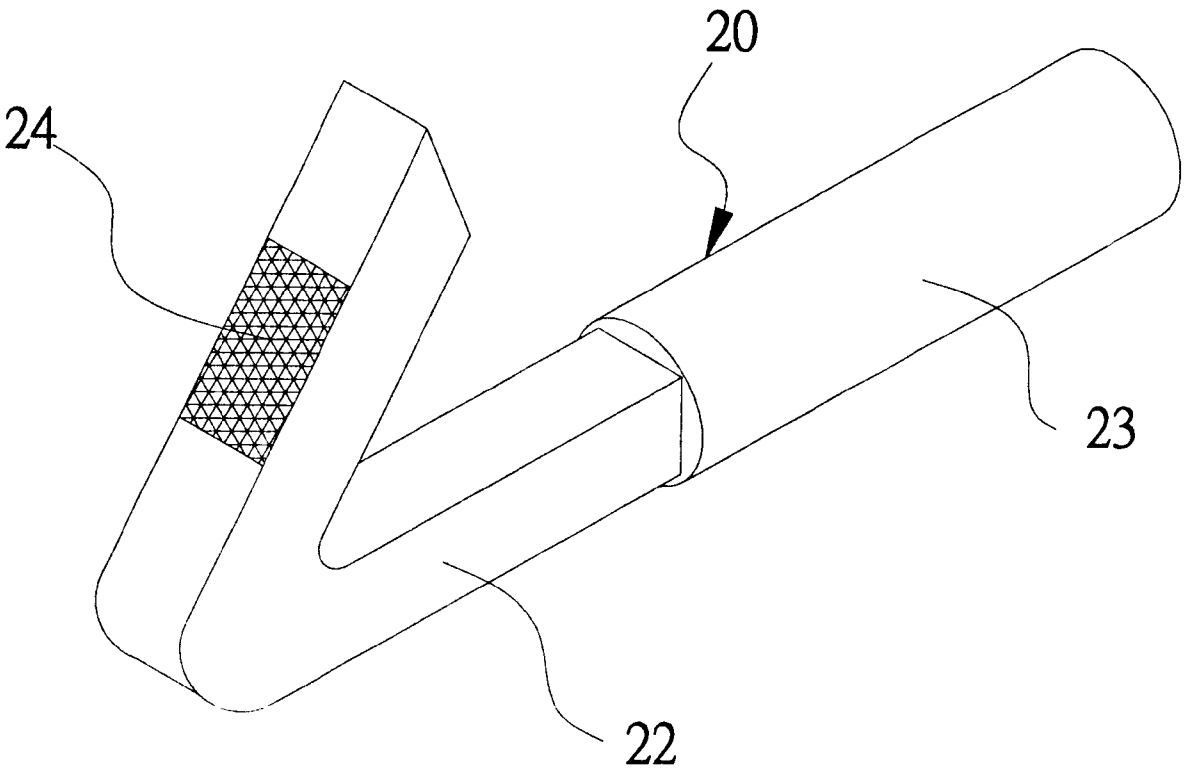
FIG. 8 is a partial schematic drawing of a continuous terminal of the present invention.

Refer to the embodiments in FIG. 5 & FIG. 8, the holding plate 10 has a holding band 14 pressed integrally with the U-shaped fixing part 11 and keeps a certain distance therebetween. The side view of the holding band 14 is also U-shaped and having a plurality of openings 141 on the vertical side thereof, corresponding the fixing part 11.

Refer to FIG. 6, wires 20 with round cross-section 23 is forged so as to form wires 20 part of round cross-section 23, part of square cross-section 22. Thus the condensability of the material of wire 20 is reformed so that the material is more durable and flexible.

Figure 4:
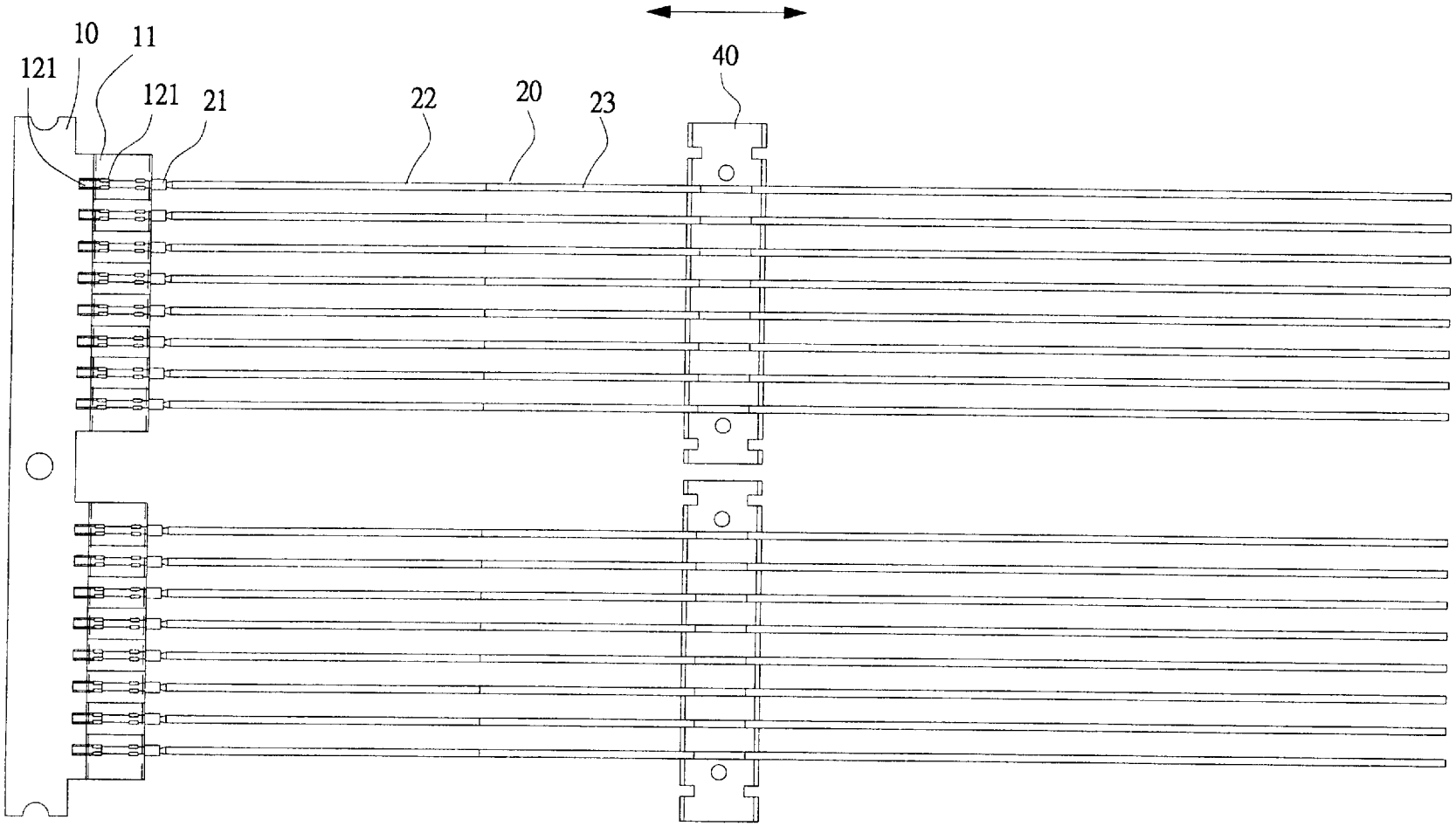
FIG. 4 is a top view of the embodiment of the present invention being assembled with a movable clamping band.
Figure 7:
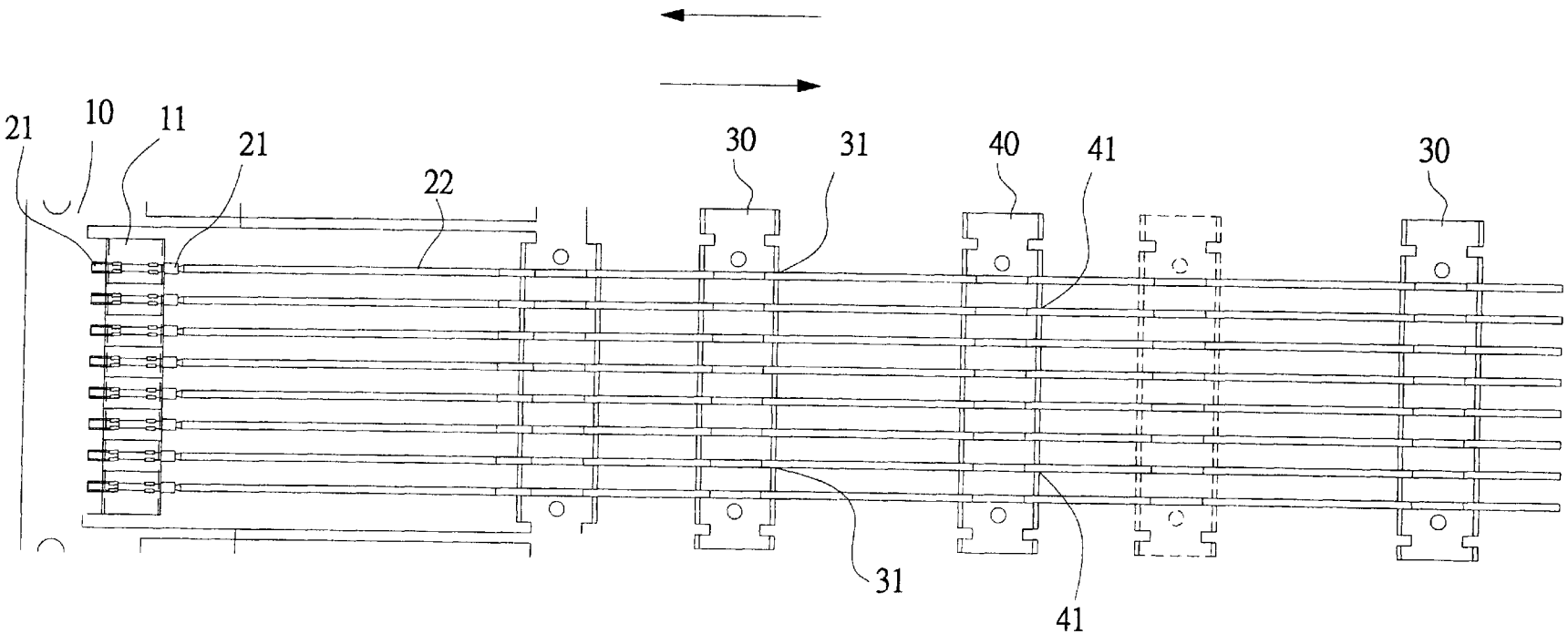
FIG. 7 is a top view of a further embodiment in accordance with the present invention.

The embodiments in FIG. 6 and FIG. 8 are applied according to different situations. For electroplating process of wires 20 with round cross-section 23, the holding plate 10 and the fixed clamping band 30 are used to provide stable alignment and supporting. As to the moveable clamping band 40, it is moveable according to the position of wires 20 need electroplating, as shown in FIG. 4 & FIG. 7, so as to provide better alignment and supporting as well as yield rate. Thus the efficiency of automatic assembling of wires 20 is also improved. Moreover, when the square cross-section 22 of the wires 20 need to be electroplated, as shown in FIG. 8, just the predetermined contact part 24 is coated with gold partially. The flat surface of the square cross-section 22 of the wires 20 is electroplated with certain thickness, the contact area is enlarged so as to raise the conductivity, but also the cost is down due to optional coating Even the wires 20 with square cross-section 22 is bended, the stress is produced in horizontal and vertical direction so that the wires is easy to straighten.

Figure 9:
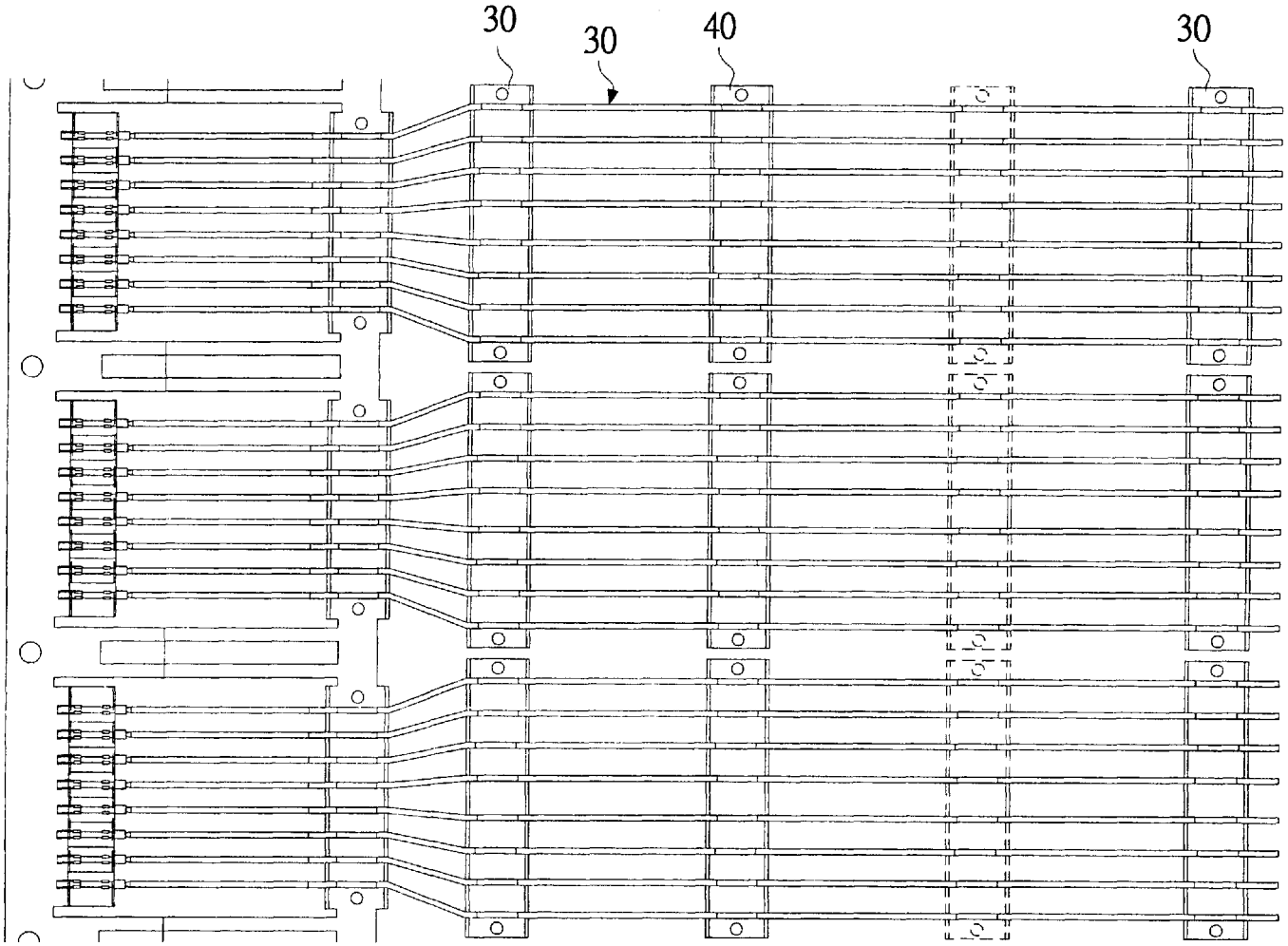
FIG. 9 is a schematic drawing of another embodiment of the present invention.

Refer to FIG. 9, the distances between two adjacent openings 31 (or 41) on the vertical wall of the fixed clamping band 30 (or the moveable clamping band 40) can be different from that of the two adjacent fixing parts 11 of the holding plate 10. When being applied, the positions of holes on the two corresponding parts are not always matching. Thus the distance between two adjacent wires 20 is adjusted by the special designed fixed clamping band 30 and/or the moveable clamping band 40 so as to meet user's requirements.

Figure 10:
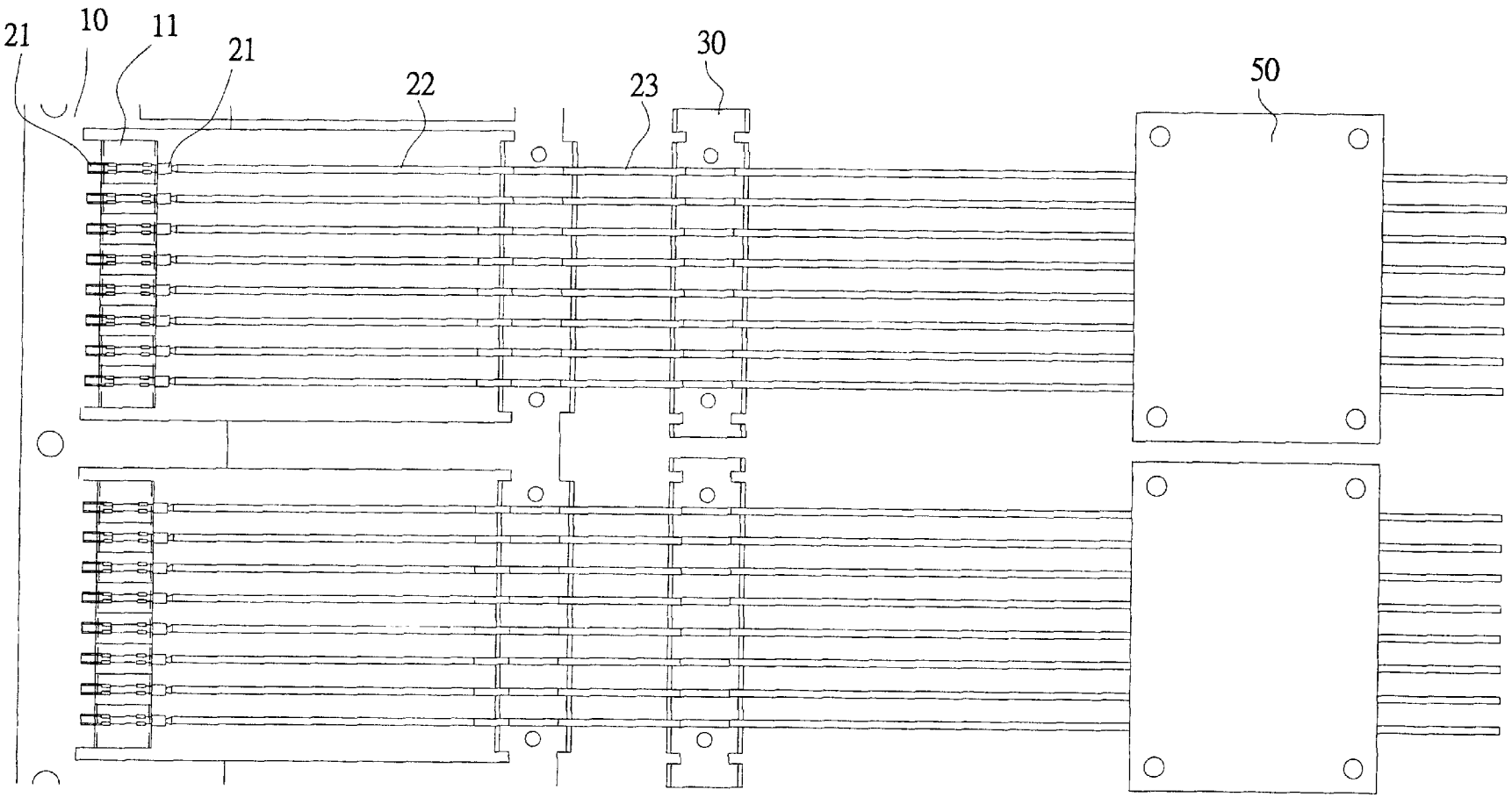
FIG. 10 is a schematic drawing of a further embodiment in accordance with the present invention.

Refer to FIG. 10, if the distance between adjacent wires 20 is to small to assemble with a moveable clamping band 40, a plastic housing 50 is formed by injection and disposed on the proper position of the end of the wires 20. Thus is helpful for the alignment while being assembled.

Figure 11A:
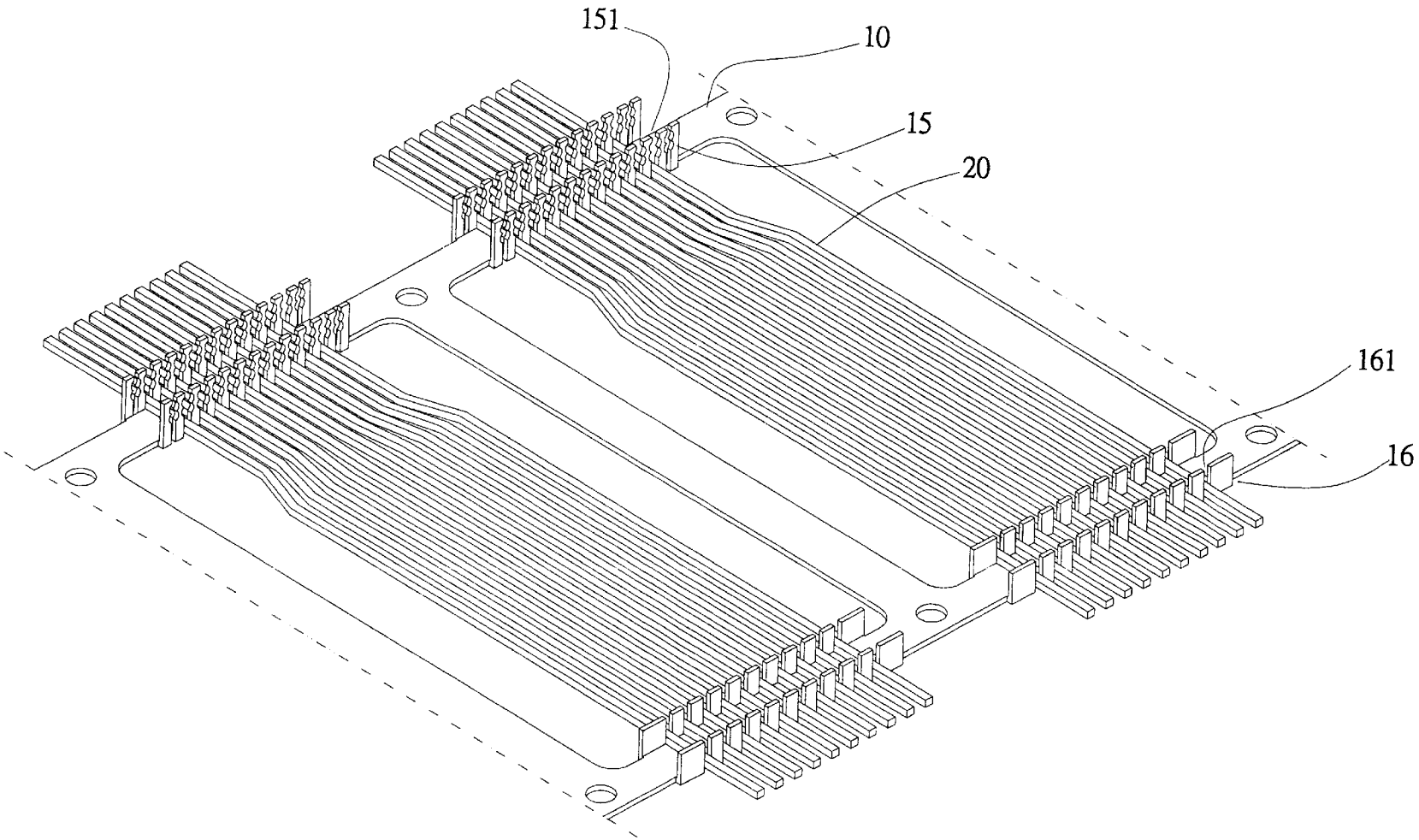
FIGS. 11 A & B are schematic drawings of a holding plate in accordance with the present invention.
Figure 11B:
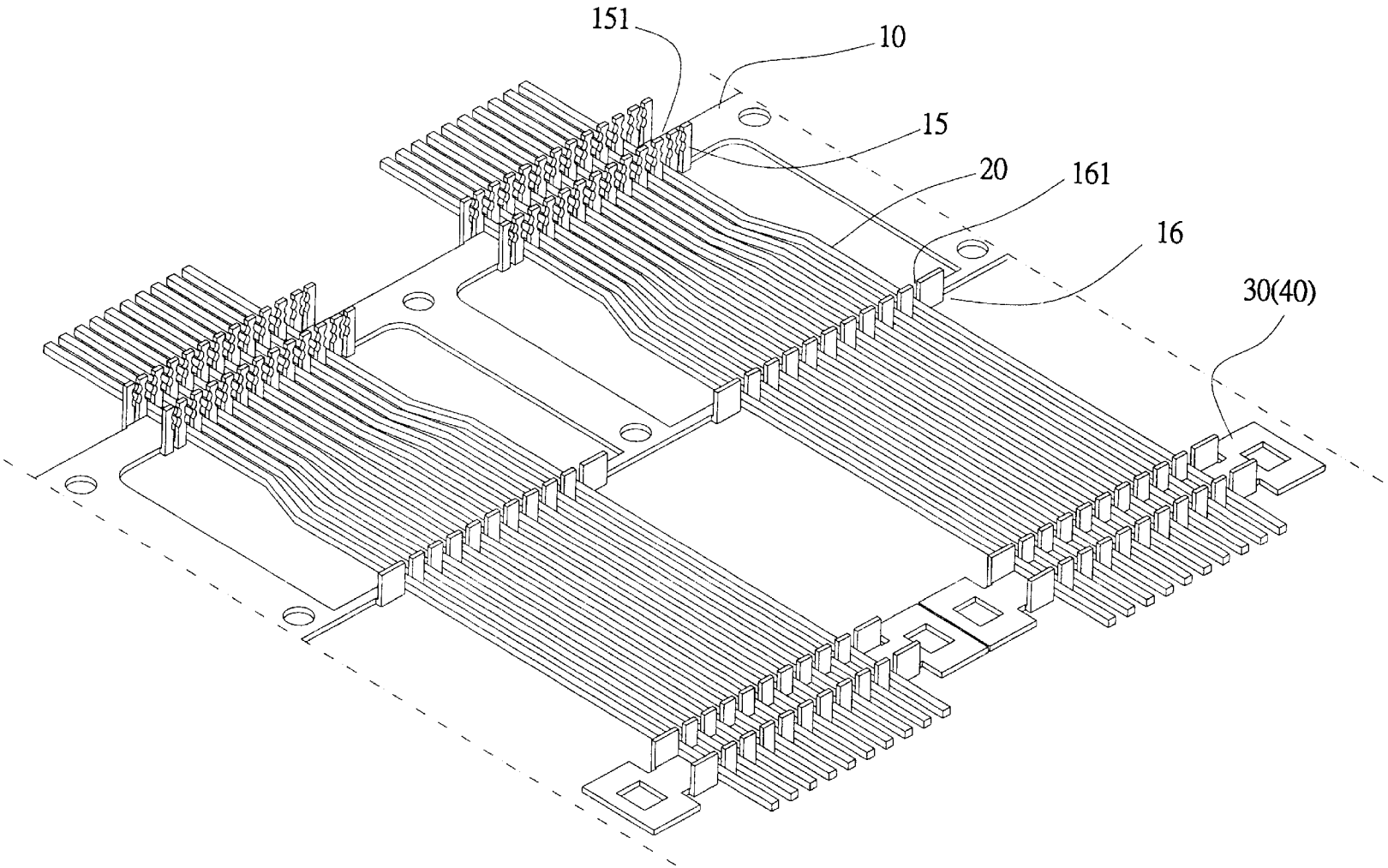
Figure 12:
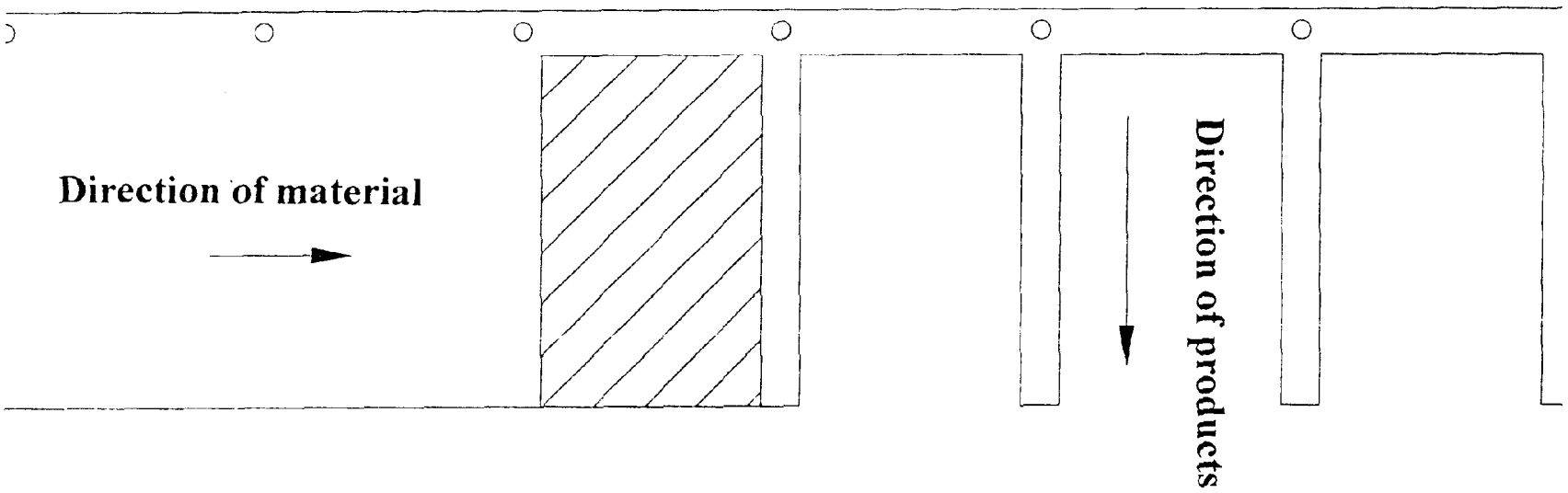
Fig.12(Prior Art)
FIG. 12 is a schematic drawing of top view of punching continuous terminals of a prior art.

Refer to FIGS. 11 A & B, a further embodiment of the holding plate 10 is composed of two holding bands 15, 16 pressed integrally. The lateral side view of the holding bands 15, 16 is U-shaped. A plurality of openings 151, 161 is aligned horizontally on the vertical wall of the holding bands 15, 16 while the distance between two adjacent openings 151 is different from that between two adjacent openings 161. In accordance with the above structure, the bent wires 20 are used for adjusting distance between adjacent wires.

According to the design of the present invention, a various types of the holding plates 10 are used in combination with at least one fixed clamping band 30 and/or one moveable clamping band 40, as shown in FIG. 11 B. The design of wires 20 is also special. Thus the present invention has following features:

1. Firmly Fixed and Excellent Alignment Effect:

The fixed clamping band and the moveable clamping band disposed on wires not only provide supporting but also for better protection and all-around alignment.

2. Wild Application Range:

Four types /of fixed clamping bands and one corresponding moveable clamping band are punching and disposed on the proper position of the wires. The processing deformation of the wires due to far supporting of the fixed clamping band can be avoided. Thus the negative factor for electroplating is also eliminated.

3. Cost Down Dramatically and Wires With Better Mechanical Property:

The wires with round cross-section has the lowest cost and part thereof is punching and forging so as to form wires with square cross-section which has the same surface area with the original round wires. Thus the wires has the advantages of the round wires such as uniform stress, low cost of cast as well as the advantages of the square wires such as better mechanical property, elasticity, malleability, equal thickness of electroplating layer and better conductivity. Instead of the cost-consuming electroplating of conventional wires, various kind of wires is optionally coated with gold, or tin-lead. The quality of products is improved and the competitiveness is increased.

It should be noted that he above description and accompanying drawing are only used to illustrate some embodiment of the present invention, not intend to limit the scope thereof. Any modification of the embodiments should fall within the scope of the present invention.

What is claimed is:

1. A clamping structure for continuous terminals comprising a holding plate, wires, a fixed clamping band, a moveable clamping band and a plastic housing; the improvement of the present invention is characterized in that:

the holding plate is pressed to form a plurality of fixing parts and a stripehole formed by pressing on the middle of each fixing part for accommodation and alignment of wires; a flat pressed stopper is; on one end of the wires and the other stopper is arranged on the position of certain distance extends from that end; the distance between the two stopper equals to that of the strip hole on the fixing part so that when the wires are mounted into the strip hole, the wires are aligned horizontally by the two stoppers being placed on two sides of the fixing part while a projecting point is pressed on the proper position of each of inner sides of the strip hole so as to align the wires vertically.

2. The clamping structure for continuous terminals as claimed in claim 1, wherein said holding plate is used in combination with at least one fixing clamping band and/or moveable clamping band after said wires being aligned thereof.

3. The clamping structure for continuous terminals as claimed in claim 2, wherein side view of the fixed clamping band and moveable clamping band is U-shaped and a plurality of opening are disposed on the vertical wall thereof, corresponding to the strip holes or the fixing parts of the holding plate.

4. The clamping structure for continuous terminals as claimed in claim 2, wherein the side view of the fixed clamping band and moveable clamping band is U-shaped a plurality of opening are disposed on the vertical wall thereof while said openings are not corresponding to the strip holes or the fixing parts of the holding plate.

5. The clamping structure for continuous terminals as claimed in claim 1, wherein the holding plate is pressed to form a plurality of fixing parts and a strip hole formed by pressing on the middle of each fixing part; a holding band is pressed integrally with the fixing part and keeps a certain distance therebetween; the cross section of said holding band is U-shaped and an opening is arranged on the vertical side thereof.

6. The clamping structure for continuous terminals as claimed in claim 5, wherein said holding plate is used in combination with at least one fixing clamping band and/or moveable clamping band after said wires being aligned thereof.

7. The clamping structure for continuous terminals as claimed in claim 1, wherein said holding plate comprising two holding bands pressed integrally; the side view of the holding bands is U-shaped and a plurality of openings is aligned horizontally on the vertical wall of the two holding bands while the distance between two adjacent openings of one holding band is different from that between two adjacent openings of the other holding band.

8. The clamping structure for continuous terminals as claimed in claim 7, wherein said holding plate is used in combination with at least one fixing clamping band and/or moveable clamping band after said wires being aligned thereof.

* * * * *